United States Patent [19]

Asano et al.

[11] Patent Number: 4,731,557

[45] Date of Patent: Mar. 15, 1988

[54] LIQUID COOLING TYPE PROJECTION PICTURE TUBE

[75] Inventors: Tetsuo Asano, Mobara; Misao Ikeda, Unakamimachi; Katsuyoshi Tamura, Mobara; Takumi Yamaguchi, Chiyodamura, all of Japan

[73] Assignee: Hitachi, Ltd., Tokyo, Japan

[21] Appl. No.: 879,138

[22] Filed: Jun. 26, 1986

[30] Foreign Application Priority Data

Jul. 5, 1985 [JP] Japan ..... 60-146501

[51] Int. Cl.[4] ..... H01J 29/86; H01J 7/24

[52] U.S. Cl. ..... 313/36; 313/477 R; 313/482

[58] Field of Search ..... 313/477 R, 482, 478, 313/36, 35, 44

[56] References Cited

U.S. PATENT DOCUMENTS

| | | | |
|---|---|---|---|
| 2,517,774 | 8/1950 | Epstein | 313/478 X |
| 2,559,353 | 7/1951 | Fisch | 313/482 X |
| 4,651,047 | 3/1987 | Comberg et al. | 313/35 X |
| 4,656,388 | 4/1987 | Strauss | 313/477 R X |

FOREIGN PATENT DOCUMENTS

| | | |
|---|---|---|
| 54-43926 | 3/1979 | Japan . |
| 55-177256 | 12/1980 | Japan . |

*Primary Examiner*—Palmer C. DeMeo

*Attorney, Agent, or Firm*—Charles E. Pfund

[57] ABSTRACT

A projection picture tube includes a bulb, a sealing chamber disposed in contact with a front surface of a phosphor screen panel of the bulb and sealed with a liquid coolant, and a holding mechanism for holding the sealing chamber by the bulb. The sealing chamber includes a transparent member disposed in front of the phosphor screen panel to be spaced apart therefrom, a heat dissipation member which is disposed between the transparent member and the phosphor screen panel and part of which is in contact with the liquid coolant sealed in the sealing chamber, seal members respectively disposed between the heat dissipation member and the phosphor screen panel and between the heat dissipation member and the transparent member, and a holding piece for holding the transparent member on the heat dissipation member. The holding mechanism is coupled to the heat dissipation member.

10 Claims, 10 Drawing Figures

LIQUID COOLING TYPE PROJECTION PICTURE TUBE

BACKGROUND OF THE INVENTION

The present invention relates to a liquid cooling type projection picture tube used in a color projector.

In a conventional color projection picture tube, respective color images are produced by corresponding mnochromatic picture tubes such as a two- or three-tube picture tube. These images are projected on a projection screen to form a color image, pixels of which are combined.

A picture tube of high brightness is desired in such a projector. Since such a picture tube has a high output, the temperature of a panel is increased upon operation for a long period of time, thereby degrading the white balance of the color image projected on the screen.

In order to solve this problem in a conventional picture tube of this type, a chamber which seals a liquid therein is disposed in contact with the panel of the phosphor screen of the picture tube to dissipate heat through a heat dissipation plate by convection of the liquid. The heat dissipation plate is arranged around the sealing chamber. The above structure is described in Japanese Utility Model Prepublication Nos. 54-43926 and 55-177256.

FIG. 9 is a sectional view showing a structure of a liquid cooling type picture tube of high brightness. Referring to FIG. 9, a phosphor screen panel 1, a funnel 2, and a neck 3 constitute a bulb 4. A phosphor screen 6 is formed on the inner surface of the bulb 4, opposite an electron gun assembly 5 arranged in the neck 3. A frame-like heat dissipation plate 7 is adhered to the peripheral portion of the panel 1 through an adhesive 8. The heat dissipation plate 7 is further adhered to a transparent panel 9 through the adhesive 8. An injection port (not shown) is formed in the heat dissipation plate 7. A sufficiently degassed coolant 10 is injected in a sealing chamber 11, formed of the phosphor screen panel 1 and the transparent panel 9, so as to completely eliminate air from the sealing chamber 11. The injection port is then completely sealed with a stopper. Heat generated by the phosphor screen panel 1 of the bulb 4 can be dissipated outside the bulb 4 through the heat dissipation plate 7 by convection of the coolant 10 which is easily convected. Therefore, the surface temperature of the phosphor screen panel 1 can be limited to about 80° C., thereby obtaining a stable image.

In the system described above, the coolant 10 in the sealing chamber 11 repeats expansion/contraction according to temperatures in operative/nonoperative states of the picture tube. The reference temperature of the coolant 10 varies on the basis of the operative or nonoperative temperature. If the reference temperature is based on the operative temperature, the coolant 10 contracts in the nonoperative state. However, if the reference temperature is based on the nonoperative temperature, the coolant 10 expands in the operative state. In either case, the sealing chamber 11 repeatedly receives the stress. When this stress exceeds the strength of the surface adhered by the adhesive 8 and defining the sealing chamber 11, the adhesive 8 is removed and the coolant 10 may leak. The adhesive 8 is normally a silicone-based organic adhesive having a high modulus of elasticity so as to absorb the stress as much as possible. The volume expansion of the coolant 10 upon an increase in temperature during use for a long period of time can be absorbed. Therefore, the liquid cooling structure can be achieved with a relatively simple structure.

With this construction, since the adhesive 8 is used to constitute the sealing chamber 11, bulky manufacturing equipment is required for maintaining and controlling cleanness of the surface of the heat dissipating plate 7 and the phosphor screen panel 1.

SUMMARY OF THE INVENTION

It is, therefore, a principal object of the present invention to provide a liquid cooling type projection picture tube having a cooling structure wherein cleanness of the surfaces of a heat dissipating plate and a phosphor screen panel can be easily maintained and controlled.

It is another object of the present invention to provide a liquid cooling type projection picture tube wherein the cooling structure can be easily assembled.

It is still another object of the present invention to provide a liquid cooling type projection picture tube wherein the cooling structure can be stably held in a bulb.

In order to achieve the above objects of the present invention, there is provided a projection picture tube comprising: a bulb; a sealing chamber disposed in contact with a front surface of a phosphor screen panel of the bulb and sealed with a liquid coolant; and a holding mechanism for holding the sealing chamber by the bulb, the sealing chamber being provided with a transparent member disposed in front of the phosphor screen panel to be spaced apart therefrom, a heat dissipation member which is disposed between the transparent member and the phosphor screen panel and part of which is in contact with the liquid coolant sealed in the sealing chamber, seal members respectively disposed between the heat dissipation member and the phosphor screen panel and between the heat dissipation member and the transparent member, and a holding piece for holding the transparent member on the heat dissipation member, the holding mechanism being coupled to the heat dissipation member.

DETAILED DESCRIPTION OF THE PREFERRED EMBODIMENTS

Figure 1:
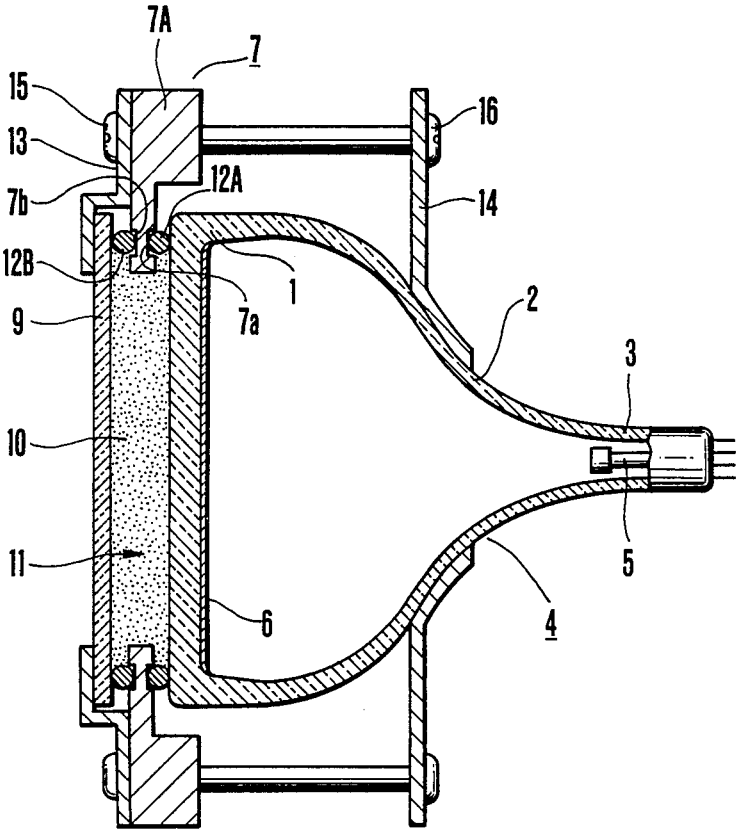
FIG. 1 is a sectional view of a liquid cooling type projection picture tube according to an embodiment of the present invention.
Figure 9:
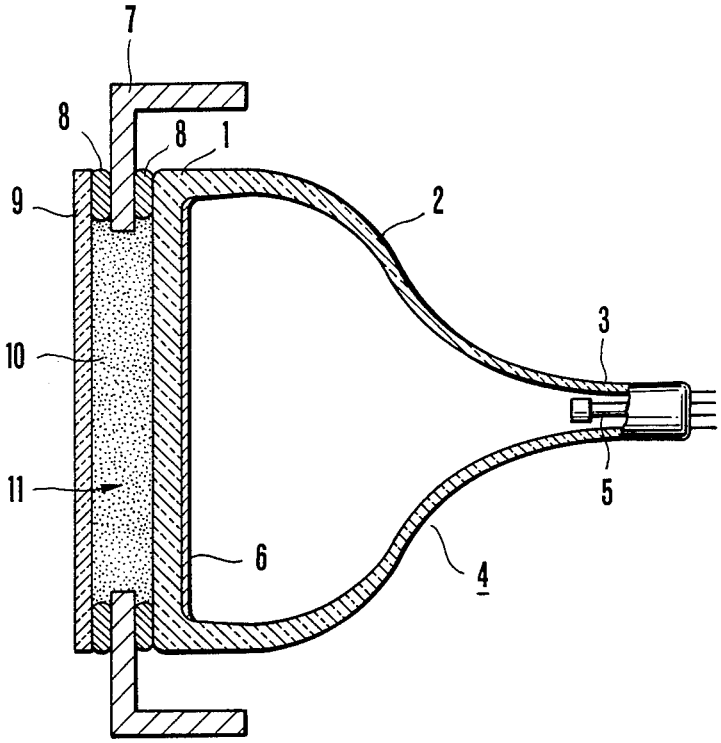
FIG.9 PRIOR ART
FIG. 9 is a sectional view showing a conventional liquid cooling type projection picture tube.

FIG. 1 shows a liquid cooling type projection picture tube according to an embodiment of the present invention. The same reference numerals as in FIG. 9 denote the same parts in FIG. 1. Referring to FIG. 1, a sealing chamber 11 is formed of an outer surface of a phosphor screen panel 1, a transparent panel 9 spaced by a predetermined distance from the outer surface of the panel 1, a metal heat dissipation plate 7 (having a material of high conductivity, such as aluminum) disposed between the outer surface of the panel 1 and the transparent panel 9 and having a central opening and a portion 7A extending outward from the side edges of the transparent panel 9 and the phosphor screen panel 1, and O-rings 12A and 12B disposed between the heat dissipation plate 7 and the transparent and phosphor screen panels 9 and 1. The liquid sealed in the chamber 11 is a coolant which is easily convected, as in the conventional coolant. Recesses 7*a* and 7*b* are formed in the inner and outer surfaces of the ends (inner edge side) of the heat dissipation plate 7 near the sealing chamber 11 so as to accommodate the O-rings 12A and 12B therein. The space between the heat dissipation plate 7 and the transparent panel 9 is hermetically sealed by the O-ring 12B and a metal piece 13. One end of the metal piece 13 is screwed by screws 15 to the end of the heat dissipation plate 7. The metal piece 13 has a stepwise cross section. Screws 16 are fastened to the heat dissipation plate 7 to fix a plate-like metal piece 14 disposed on the rear surface of a funnel 2. The screws 15 and 16 are independently fastened to adjust the O-ring 12B and the O-ring 12A disposed between the heat dissipation plate 7 and the phosphor screen panel 1 at a predetermined compression ratio, thereby obtaining a desired pressure of the sealing chamber. A volume changing device such as a conventional bellows (not shown) is mounted on part of the heat dissipation plate 7. The plate metal piece 14 has a central opening. The plate metal piece 14 edge defining the opening is pressed such that the edge is located along the sides of the funnel 2.

In this embodiment, the phosphor screen panel 1 has a rectangular shape, as do the transparent panel 9, the heat dissipation plate 7, and the metal pieces 13 and 14, all of which correspond to the panel 1. The screws 15 and 16 are located at four corners of this rectangular shape.

With this structure, the sealing chamber 11 can be held or locked with reference to a bulb 4. The sealing chamber 11 and the heat dissipation plate 7 can be assembled together in the assembly of the picture tube, thereby simplifying the assembly compared with the manufacture of the picture tube in FIG. 9.

With this structure, however, the metal piece 14 cannot be properly fitted on the curved surface of the funnel 2 to degrade the sealing property of the chamber 11 with the bulb 4. When the projector having this picture tube is dropped or an impact such as vibrations acts thereon, the position of the bulb 4 is deviated. As a result, sealing of the sealing chamber 11 by the O-rings 12A and 12B is degraded.

Another embodiment which solves the above problem will be described below.

Figure 2A:
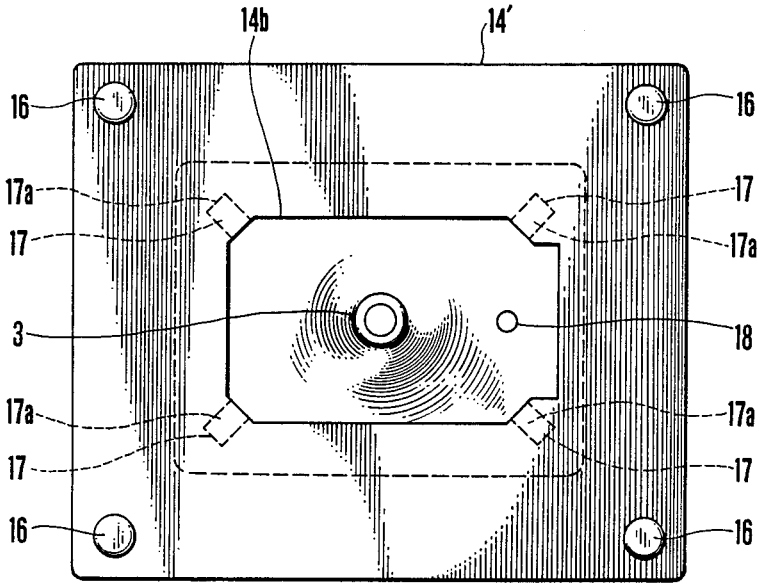
FIGS. 2(*a*) and 2(*b*) are respectively a front view and a sectional view of a liquid cooling type projection picture tube according to another embodiment of the present invention.
Figure 2B:
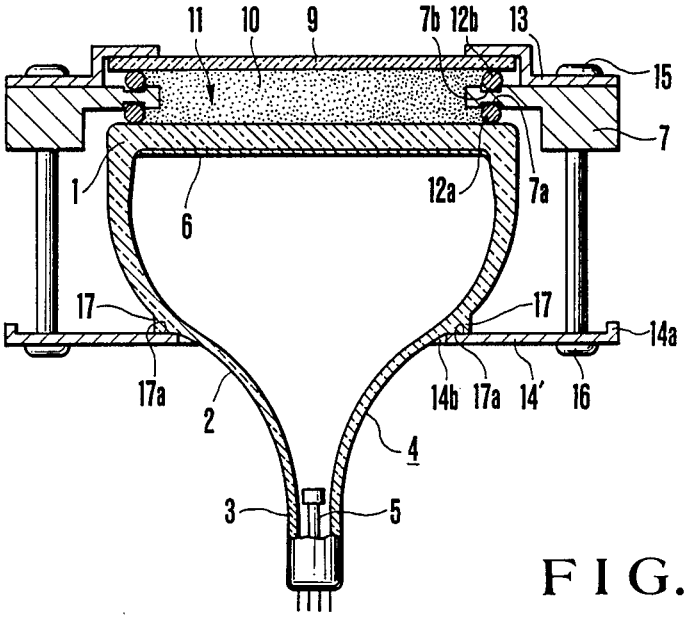

The same reference numerals as in FIG. 1 denote the same parts in FIGS. 2(*a*) and 2(*b*). Referring to FIGS. 2(*a*) and 2(*b*), pads 17 respectively extend outward at corners of a funnel 2 of a bulb 4. The pads 17 respectively have lock surfaces 17*a* substantially perpendicular to the tube axis. Reference numeral 18 denotes a cap for supplying a high voltage to the electrodes in the bulb 4.

A metal piece 14' of the funnel 2 has reinforcing bent portions 14*a* at the outer edge. A frame-like opening 14*b* is formed at a central portion so as to match the pads 17 at four corners thereof. The metal piece 14' is located spaced apart from the cap 18 along the tube axis.

With the above structure, the metal piece 14' abuts against the entire surfaces of the lock surfaces 17*a* of the pads 17 located at four corners of the funnel 2. A metal piece 13 for holding the transparent panel 9 is fixed by screws 15 and 16, at a predetermined torque to the heat dissipation plate 7. O-rings 12*a* and 12*b* are compressed at a predetermined compression ratio and are hermetically sealed. In this manner, the sealing chamber 11 is supported by and fixed to the funnel 2.

With the above structure, in addition to the effect obtained by the structure in FIG. 1, the bulb 4 can be firmly held despite dropping of the projector or vibrations acting thereon since the metal piece 14' is in contact with the entire lock surfaces 17*a* of the pads 17. Therefore, the sealing property of the O-rings 12*a* and 12*b* is not degraded since the position of the bulb 4 is not shifted.

Figure 3:
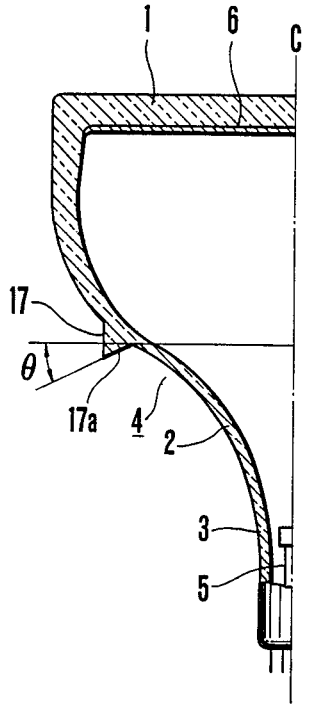
FIG. 3 is a sectional view showing the main part of an arrangement of a lock portion of the picture tube in FIG. 2.

With the above structure, the pads 17 as the lock portions are disposed substantially perpendicular to the tube axis. However, as shown in FIG. 3, the lock surfaces 17*a* may be inclined at an angle $\theta$ with respect to a plane perpendicular to a tube axis C. In this case, the metal piece 14' can be further firmly locked, and thus a good locking effect can be obtained. If the inclination angle of the lock surface 17*a* is set to be (obtuse angle—$\theta$), the lock surfaces 17*a* tend to undesirably fall off from the opening 14*b* of the metal piece 14'.

Figure 4:
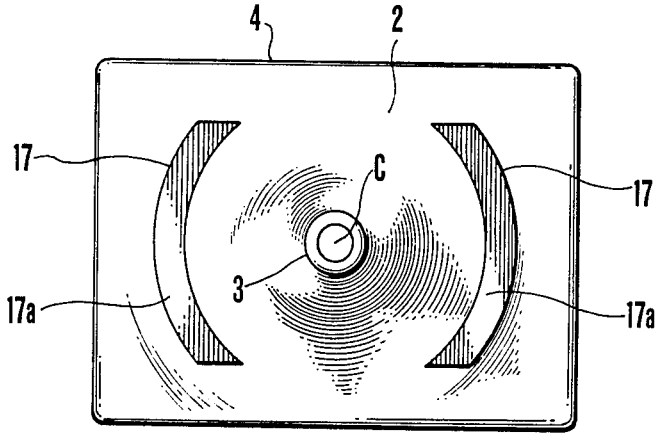
FIG. 4 is a plan view showing another arrangement of the lock portion of the picture tube in FIG. 2.

In the above embodiment, the pads 17 are respectively disposed at the four corners of the funnel 2. However, two arcuated pads symmetrical about the tube axis C may be disposed at two sides of the funnel, as shown in FIG. 4, to obtain the same effect as described above.

Figure 5:
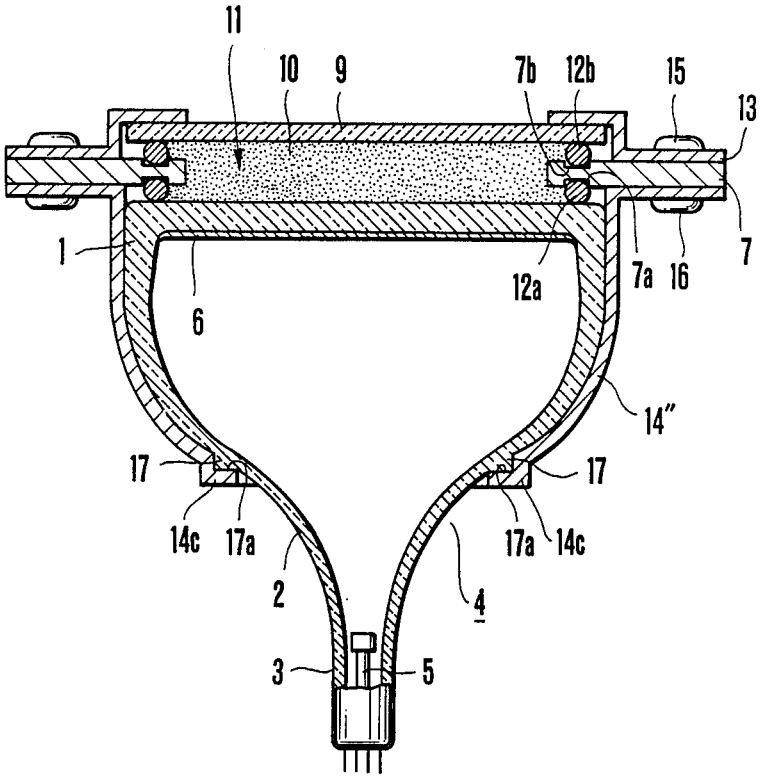
FIG. 5 is a sectional view of a liquid cooling type projection picture tube according to still another embodiment of the present invention.

FIG. 5 shows a liquid cooling type projection picture tube according to still another embodiment of the present invention. The same reference numerals as in FIGS. 1 to 4 denote the same parts in FIG. 5. The picture tube in FIG. 5 differs from that in FIG. 2 in that a metal piece 14'' has substantially the same shape as the outer shape of a funnel 2 and has inward bent portions 14*c*. The bent portions 14*c* are respectively in contact with flat surfaces 17*a* of four pads 17 and are fastened by screws 15 and 16 together with a metal piece 13 and a heat dissipation plate 7.

With the above structure, the same effect as previously mentioned can be obtained. In addition, an external magnetic shielding effect can also be obtained.

Figure 6:
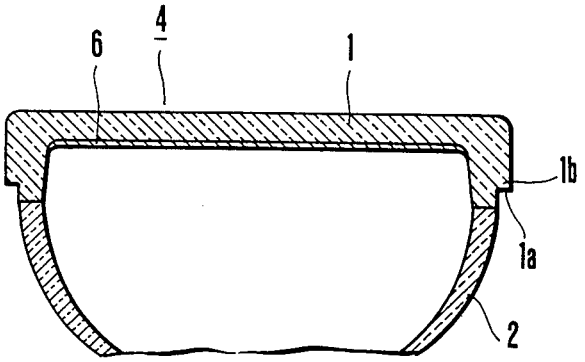
FIGS. 6 to 8 are respectively sectional views of bulbs according to other embodiments of the present invention.
Figure 7:
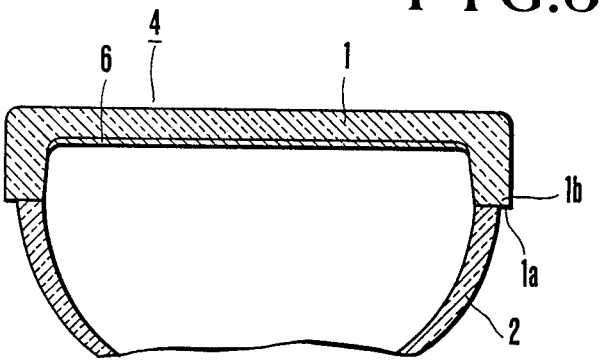
Figure 8:
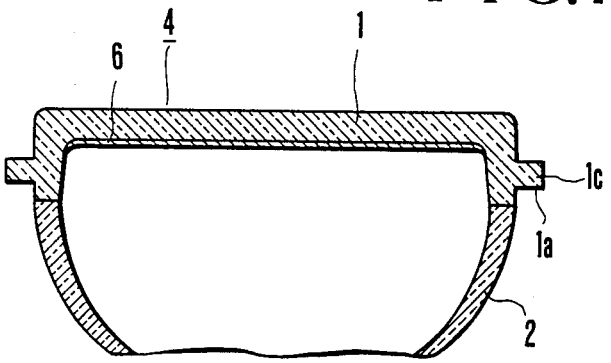

In the above embodiment, the pads 17 as the lock portions of a sealing chamber 11 are mounted on the funnel 2. However, the present invention is not limited to this structure. As shown in FIG. 6, an opening end of a phosphor screen panel may have a larger thickness. Step portions 1*b* having lock surfaces 1*a* substantially perpendicular to the tube axis can be formed at four corners of a panel 1. The diameter of an inner edge opening 14*b* of the metal piece 14' in FIG. 4 can be increased, and the inner edge of the larger opening can be brought into contact with the lock surfaces 1*a* of the step portions 1*b*. As shown in FIG. 5, these members can be fastened by screws 16, thereby obtaining substantially the same effect as in FIG. 2. Another structure is shown in FIG. 7. Referring to FIG. 7, the opening end of a phosphor screen panel 1 may have a larger thickness. The peripheral portion of the opening end face can be utilized to obtain substantially the same effect as previously mentioned. Still another structure is shown in FIG. 8. Projections 1*c* having lock surfaces 1*a* may be formed on the outer surface of a phosphor screen panel 1 in a direction substantially perpendicular to the tube axis, to obtain substantially the same effect as described above. Steps 1*b* or the projections 1*c* as lock portions are respectively formed at the four corners of the phosphor screen panel 1. However, a step or a projection may be formed along the outer surface of the opening end to achieve a stabler support structure. A metal piece 13 may be a single plate or split plate members if sealing of a sealing chamber is sufficiently maintained.

According to the embodiments in FIGS. 2 to 8 as described above, the lock portions are formed on the bulb to support the sealing chamber, and thus the bulb can be stably supported against an impact. As a result, a liquid cooling type projection picture tube of high quality and high reliability can be achieved.

The present invention is not limited to the particular embodiments described above. Various changes and modifications may be made within the spirit and scope of the invention.

For example, in the above embodiments, the transparent panel comprises a plate. However, the transparent panel may be a member with a lens function.

What is claimed is:

1. A projection picture tube comprising:

a bulb;

a sealing chamber disposed in contact with a front surface of a phosphor screen panel of said bulb and sealed with a liquid coolant; and a holding mechanism for holding said sealing chamber by said bulb, said sealing chamber being provided with a transparent member disposed in front of said phosphor screen panel to be spaced apart therefrom, a heat dissipation member which is disposed between said transparent member and said phosphor screen panel and part of which is in contact with the liquid coolant sealed in said sealing chamber, seal members respectively disposed between said heat dissipation member and said phosphor screen panel and between said heat dissipation member and said transparent member, and a holding piece for holding said transparent member on said heat dissipation member, said holding mechanism being coupled to said heat dissipation member.

2. A tube according to claim 1, wherein said bulb includes a funnel and said holding mechanism comprises a plate-like member having an opening matching with an outer diameter of said funnel, and a coupling member for coupling said plate-like member to said heat dissipation plate.

3. A tube according to claim 1, wherein said bulb includes a funnel and a lock portion to which said holding mechanism is locked.

4. A tube according to claim 3, wherein said lock portion is formed on an outer surface of said funnel.

5. A tube according to claim 3, wherein said lock portion comprises two arcuated members formed at two sides of a tube axis.

6. A tube according to claim 3, wherein said lock portion is formed on a side wall of said phosphor screen panel.

7. A tube according to claim 4, wherein said lock portion is inclined at a given angle with respect to a plane perpendicular to a tube axis.

8. A tube according to claim 1, wherein said bulb includes a funnel and said holding mechanism comprises a holding member disposed from said heat dissipation member to said funnel along an outer surface of said bulb, and a fixing member for fixing said holding member to said heat dissipation member.

9. A tube according to claim 3, wherein said lock portion comprises step portions having lock surfaces in a direction substantially perpendicular to a tube axis.

10. A tube according to claim 3, wherein said lock portion comprises wall portions of said phosphor screen panel, said wall portions having a larger thickness than that of said funnel.

* * * * *